US012241475B2

(12) United States Patent
Heigold et al.

(10) Patent No.: US 12,241,475 B2
(45) Date of Patent: Mar. 4, 2025

(54) RADIAL IMPELLER

(71) Applicant: Nicotra Gebhardt GmbH, Waldenburg (DE)

(72) Inventors: Thomas Heigold, Gaisbach (DE); Klaus Gundel, Kupferzell-Belzhag (DE)

(73) Assignee: Nicotra Gebhardt GmbH, Waldenburg (DE)

( * ) Notice: Subject to any disclaimer, the term of this patent is extended or adjusted under 35 U.S.C. 154(b) by 0 days.

(21) Appl. No.: 17/966,255

(22) Filed: Oct. 14, 2022

(65) Prior Publication Data

US 2023/0124865 A1 Apr. 20, 2023

(30) Foreign Application Priority Data

Oct. 15, 2021 (EP) ..... 21202991

(51) Int. Cl.
*F04D 29/24* (2006.01)
*F04D 29/30* (2006.01)

(52) U.S. Cl.
CPC ..... *F04D 29/24* (2013.01); *F04D 29/30* (2013.01)

(58) Field of Classification Search
CPC ..... F04D 29/2222; F04D 29/62; F04D 29/624
See application file for complete search history.

(56) References Cited

U.S. PATENT DOCUMENTS 3,107,627 A * 10/1963 Clarke ..... F04D 29/2222 416/182
10,550,854 B2 2/2020 Lorcher et al.

FOREIGN PATENT DOCUMENTS

| | | | |
|---|---|---|---|
| CN | 212028170 | U | 11/2020 |
| DE | 102011013841 | A1 | 9/2012 |
| EP | 1995466 | A1 | 11/2008 |
| EP | 2835539 | A1 | 2/2015 |
| EP | 2942531 | A1 | 4/2015 |
| WO | 2014168261 | A1 | 10/2014 |

* cited by examiner

*Primary Examiner* — Brian O Peters
(74) *Attorney, Agent, or Firm* — The Webb Law Firm

(57) ABSTRACT

A radial impeller having a cover plate with an inlet opening and a support plate, the plates being connected to one another by means of a vane ring having multiple vanes. The vanes each have two side edges opposite one another, one of which is connected to the cover plate and the other to the support plate. The side edges each extend between a vane inlet edge and a vane outlet edge which is opposite in a circumferential direction of the impeller. The vanes are each designed as a hollow profile and have two vane halves delimiting a cavity between them which are applied to one another and are each connected to one another in the region of the vane inlet edge and the vane outlet edge by means of a welded connection.

12 Claims, 4 Drawing Sheets

RADIAL IMPELLER

CROSS-REFERENCE TO RELATED APPLICATION

This application claims priority to European Patent Application No. 21 202 991.2 filed Oct. 15, 2021, the disclosure of which is hereby incorporated by reference in its entirety.

BACKGROUND

Field

The invention relates to a radial impeller having a cover plate with an inlet opening and a support plate, said plates being connected to one another by means of a vane ring having multiple vanes, wherein said vanes each have two side edges opposite one another, one of which is connected to the cover plate and the other to the support plate, wherein the side edges each extend between a vane inlet edge and a vane outlet edge which is opposite in a circumferential direction of the impeller.

Description of Related Art

Radial impellers of this kind have been known in the art for some time. One aim of the development of radial impellers is to provide a radial impeller which has a high degree of efficiency. Different approaches have been taken to this in the past, for example DE 10 2011 013 841 A1 discloses a radial fan wheel having a cover plate and a support plate which are connected to one another by means of a vane ring. The vane ring has a plurality of vanes tilted from the inside outwards against the running direction, said vanes each having a vane inlet edge and a vane outlet edge arranged further outwards in the radial direction. The degree of efficiency of this radial fan wheel was improved in that the vane inlet edges each have a straight profile starting from the cover plate in the direction of the support plate with one component in the radial direction and one component in the circumferential direction.

Another approach for improving the degree of efficiency is described in EP 2 942 531 A1, in which the impeller is produced in one piece overall as an injection-moulded part, wherein the vanes have a 3D geometry.

SUMMARY

The problem addressed by the invention is that of creating a radial impeller of the kind referred to above which is characterized by a high degree of efficiency, is weight-optimized and can be produced in a cost-effective manner.

This problem is solved by a radial impeller having the features as described herein. Developments of the invention are presented as described herein.

The radial impeller according to the invention is characterized in that the vanes are each designed as a hollow profile and have two vane halves delimiting a cavity between them which are applied to one another and are each connected to one another in the region of the vane inlet edge and the vane outlet edge by means of a welded connection.

The embodiment of the vanes as hollow profiles produces a weight saving compared with vanes formed from solid material. The production of hollow profile vanes of this kind from the two vane halves is relatively simple to carry out, said vane halves only having to be welded to one another in the region of the vane inlet edge and the vane outlet edge.

The vanes are advantageously each made of lightweight metal or a lightweight metal alloy, wherein aluminium or an aluminium alloy are particularly suited as the lightweight metal or lightweight metal alloy. In particular, aluminium alloys of this kind have the advantage that the mechanical strength, ductility and fracture toughness at low temperatures increases. In addition, in terms of corrosion, they are resistant to saltwater.

In a development of the invention, the vanes each have an inlet end region which tapers towards the vane inlet edge and which is formed by end portions of the two vane halves curved convexly on the outer faces of the vane halves facing away from one another, in such a manner that the inlet end region has a continuously curved outer contour extending over both vane halves. The vanes in this case each have a profile nose curved in an arcuate manner on the vane inlet edge or a radius which is part of the profile of the vane. The two vane halves therefore form, along with the inlet end region continuously curved on its outer contour, a wing profile which is optimized in terms of flow and which likewise helps to improve the degree of efficiency overall, particularly in relation to "sharp-edged vane inlet edges". The vanes designed as hollow profiles have a 3D geometry.

In a particularly preferred manner, the convexly curved end portions are each designed as formed portions produced without machining by plastic forming of a vane half blank. Stamping of the vane half blanks is particularly suitable as plastic forming. In this case, the convexly curved end portions are stamped.

In a particularly preferred manner, the welded connection is a laser-welded connection. A laser-welded connection of this kind has the advantage that the heat input during welding is relatively small. This means that the distortion of the parts being welded due to the effects of heat can be limited.

It is possible for the welded connection to have at least one welded seam extending substantially over the entire length of the vane inlet edge and/or the vane outlet edge. Alternatively, it is conceivable for the welded connection also to be produced by means of spot welding.

In a particularly preferred manner, the vanes are designed as components which are separate from the cover plate and the support plate and are each connected in the region of their side edges firstly to the cover plate and secondly to the support plate by means of the fastening measure.

In a particularly preferred manner, the fastening measures comprise a welded connection, with which the vanes are each welded firstly to the cover plate and secondly to the support plate. A laser welded connection is once again particularly suitable as the welded connection, in order to reduce the heat input.

In a particularly preferred manner, the fastening measures comprise, in addition to the welded connection, a form-fitting connection, with which the vanes are connected firstly to the cover plate and secondly to the support plate.

In a particularly preferred manner, the form-fitting connection is designed as a plug connection with plug elements and mating plug elements assigned to one another formed firstly on the side edges of the respective vanes and secondly on the cover or support plate.

In a particularly preferred manner, the plug elements are particularly designed as particularly elongate plug pins, preferably plug tabs, and the mating plug elements are designed as receiving openings, in particular receiving slots, receiving the plug tabs. The plug pins are advantageously located on the vanes and the receiving openings on the cover and support plate. It would be conceivable, however, for plug pins to be formed on the cover and support plate and for receiving openings, in particular receiving slots, to be formed on the side edges of the vanes.

In a particularly preferred manner, the elongate plug pins are adapted to the contour of the outer surfaces of the vane halves and likewise have a convexly curved design, wherein the contour of the receiving slot is adapted to the contour of the elongate plug pins.

The vanes each have two outer faces turned away from one another, of which the outer face which is at the front in the running direction and is convexly curved, in particular, represents the pressure side and the opposite outer face, which is concavely curved where appropriate, represents the suction side. It is possible for the elongate plug pins to be arranged on the side edges of the vanes in such a manner that the elongate plug pins are assigned to the pressure side and the suction side in alternating fashion. The elongate plug pins are therefore advantageously located proximate to the pressure side and thereby form a virtual extension of the outer face, wherein the next elongate plug pin along the side edge is then arranged on the suction side as a quasi-extension to said suction side.

In a particularly preferred manner, the vanes are tilted from the inside outwards against the running direction and are designed in the form of backwardly curved vanes.

The vane inlet edge and/or the vane outlet edge of a respective vane advantageously has/have an arcuate profile starting from the cover plate in the direction of the support plate.

The invention further comprises a method for producing a radial impeller as described herein, said method having the following steps:

- provision of two vane halves and assembly of the two vane halves in such a manner that a hollow profile is formed and the two vane halves together form a vane inlet edge and a vane outlet edge,
- welding of the two vane halves in the region of the vane inlet edge and the vane outlet edge to form a vane,
- implementation of the aforementioned method steps to produce all vanes of the vane ring,
- connection of the vanes in the region of the side edges thereof, firstly to the cover plate and secondly to the support plate.

The vane halves are advantageously each plastically formed prior to assembly, in particular stamped, in order to produce convexly curved inner portions.

In a development of the invention, the vanes are connected to the cover plate and the support plate in a form-fitting manner via the combination of plug pins at the receiving slot and then the plug connections of the plug pins with the receiving slots are welded.

The welding advantageously takes place on an outer side of the cover plate or support plate facing away from the vane ring.

BRIEF DESCRIPTION OF THE DRAWINGS

A preferred exemplary embodiment is presented in the drawing and explained in greater detail below. In the drawing.

DETAILED DESCRIPTION

Figure 1:
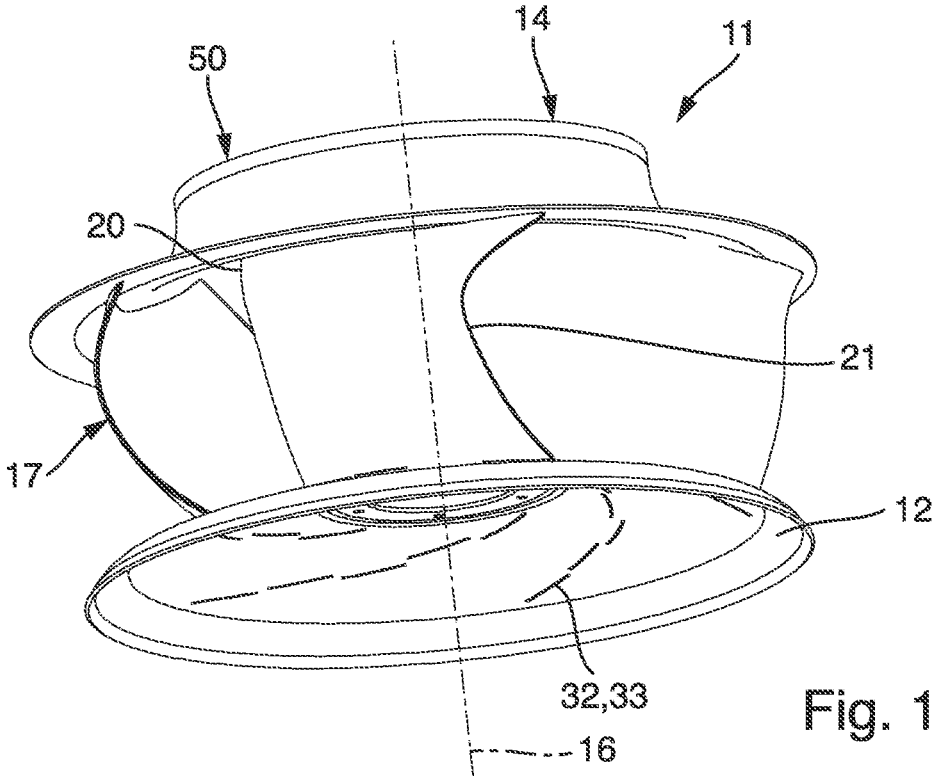
FIG. 1 shows a perspective representation of a preferred exemplary embodiment of the radial impeller according to the invention.

FIGS. 1 to 8 show a preferred exemplary embodiment of the radial impeller 11 according to the invention. The radial impeller, which could also be referred to as the impeller, for the sake of simplicity, is an integral part of a radial fan (not shown) which, furthermore, also has a fan drive (not shown) by means of which the radial impeller 11 can be driven in a rotary manner. The radial fan may be one with a belt drive or direct drive. In the former case, a belt guarantees the transmission of power from the fan drive to the radial fan wheel 11. In the case of the directly driven radial fan, the fan drive may be fitted to the radial impeller, for example in that a drive shaft of the fan drive is coupled to a hub arrangement 13 of the radial impeller 11 formed on a support plate 12.

The preferred exemplary embodiment shown in FIGS. 1 to 8 shows, purely by way of example, a radial impeller 11 which is intended for the direct drive.

As shown in FIGS. 1, 5, 7 and 8, in particular, the radial impeller 11 has a cover plate 14 which has a circular inlet opening 15 that defines a suction diameter. The inlet opening 50 in this case is located on an adapter 15 projecting on the outside of the cover plate, which adapter extends inwardly in the axial direction along a rotational axis 16 in a trumpet shape. The trumpet-shaped extension of the adapter 15 ensures an improved deflection from the axial into the radial flow direction. The radius of the curvature may fall within the range of 10% to 30% of the suction diameter, for example.

In addition, a support plate 12 is provided which is arranged coaxially to the cover plate 14. The cover and support plates 12, 14 are connected to one another via a vane ring 17. The hub arrangement 13 already mentioned previously is located on the support plate 12, said hub arrangement being used for coupling to a drive shaft of a fan drive (not shown). The outer diameter of the support plate 12 is smaller than the outer diameter of the cover plate 14, or is roughly the same size.

The vane ring 17 is composed of a plurality of vanes 18, which are each tilted from the inside outwards against the running direction. In the present exemplary case, vanes 18 which are curved backwards are provided.

The vanes 18 each have two side edges 19*a*, 19*b* opposite one another, one of which is connected to the cover plate 14 and the other to the support plate 12. The side edges 19*a*, 19*b* each extend between a vane inlet edge 20 and a vane outlet edge 21 located opposite in a circumferential direction of the impeller.

Figure 6:
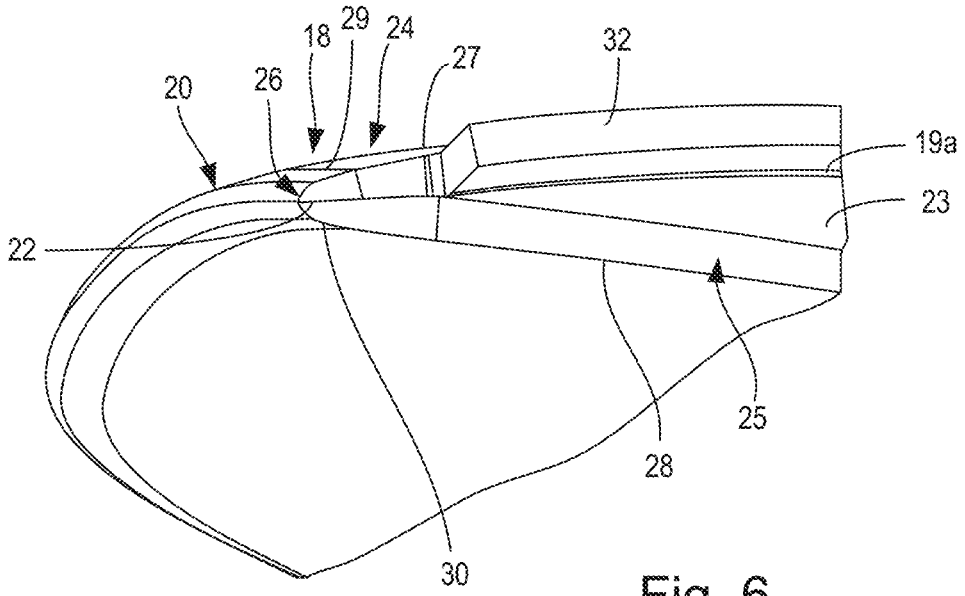
FIG. 6 shows an enlarged representation of the detail X in FIG. 3.

As shown in FIG. 6, in particular, the vanes 18 are each designed as a hollow profile and have two vane halves 24, 25 delimiting a cavity 23 between them which are applied to one another and are each welded to one another in the region of the vane inlet edge 20 and the vane outlet edge 21 by means of a welded connection 22.

As is further shown in FIG. 6, the vanes 18 each have an inlet end region 26 which tapers towards the vane inlet edge 20 and which is formed by end portions 29, 30 of the two vane halves 24, 25 curved convexly on the outer faces 27, 28 of the vane halves 24, 25 facing away from one another, in such a manner that the inlet end region 26 has a continuously curved outer contour extending over both vane halves 24, 25.

Figure 5:
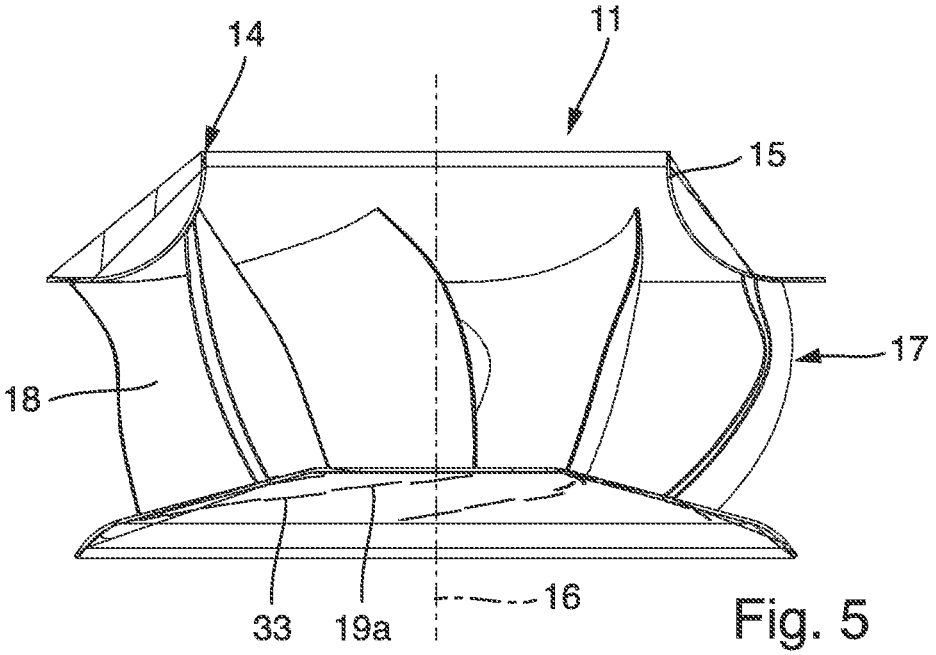
FIG. 5 shows a longitudinal section through the radial impeller in FIG. 1.
Figure 7:
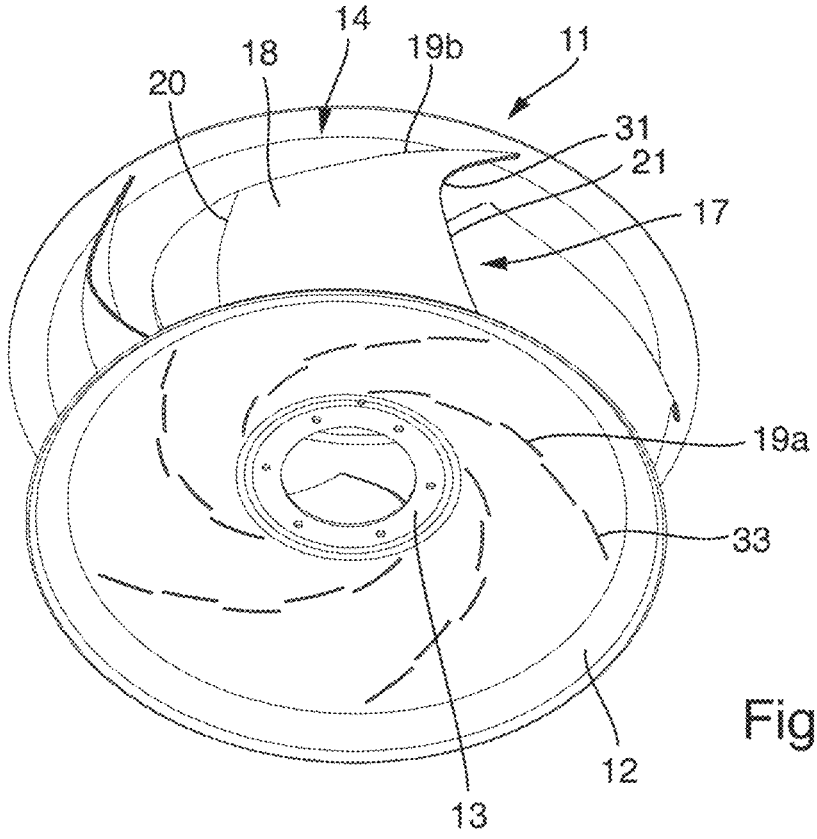
FIG. 7 shows a perspective view of the radial impeller from FIG. 1 seen from the side of the support plate obliquely from the top and FIG. 8 shows a perspective view of the radial impeller from FIG. 1 seen from the side of the cover plate obliquely from the top.

As shown in FIGS. 5 and 7 in particular, the vanes 18 are each turned in on themselves, i.e. the side edges 19*a*, 19*b* of a respective vane 18 which are opposite one another have different profiles from one another.

The convexly curved end portions 29, 30 are each designed as formed portions produced without machining by plastic forming, in particular stamping, of a vane half blank.

The vanes 18 are each made of aluminium or an aluminium alloy. Combined with the hollow profile of the vanes, this produces a weight saving compared with traditional vanes made of solid sheet steel.

Figure 2:
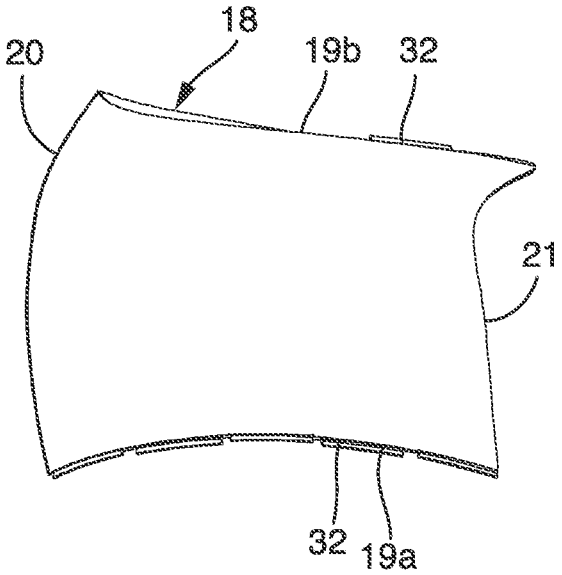
FIG. 2 shows a perspective side view of a vane of the radial impeller in FIG. 1.
Figure 3:
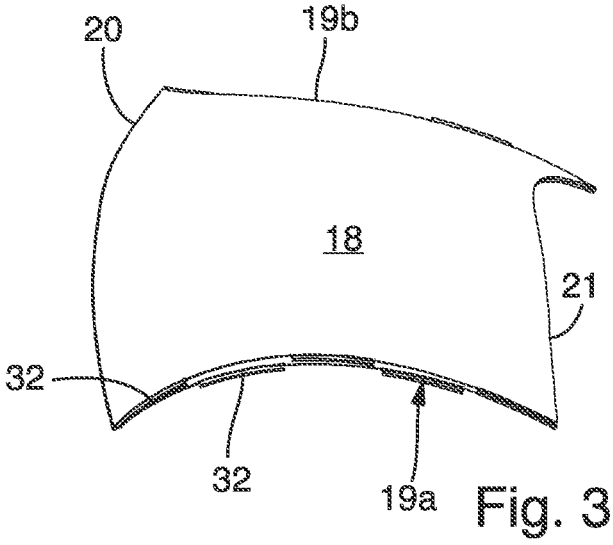
FIG. 3 shows a different perspective view of the vane in FIG. 2.
Figure 4:
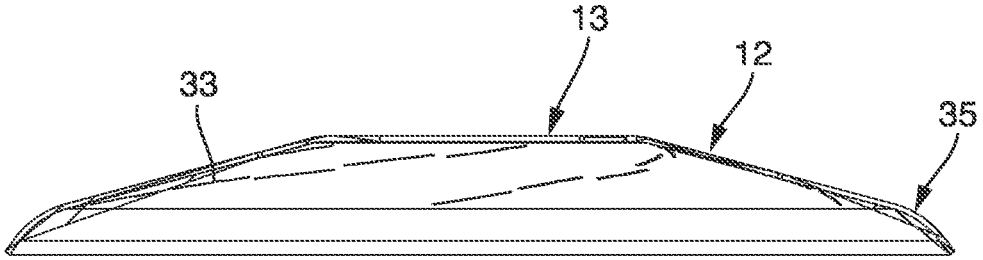
FIG. 4 shows a longitudinal section through the support plate of the radial impeller in FIG. 1.

As can be seen in FIGS. 2 and 3, in particular, the vanes 18 are therefore designed as hollow profile vanes. The vane geometry may be formed from multiple, axially offset sections perpendicular to the axis of rotation. In this case, different inlet and outlet angles and diameter ratios and vane radii are used for each section. The final shape of the hollow profile vane is formed from the vane geometry and a superimposed NACA profile geometry. The vanes may therefore be designed as a kind of wing profile.

As shown in FIG. 1, in particular, the meridian contour 31, in particular, at the vane outlet edge 21 of the radial impeller 11 determines the final shape of the vane 18. One parameter which is important to the inward flow of the vanes 18 is the so-called vane inlet angle $\beta_1$. This is formed as the angle of a tangent at an inner base point of the vane 18 to the tangent to the circle circumference running through said base point. The vane inlet angle $\beta_{1,\ TS}$ in this case is different in the region of the support plate from the vane inlet angle $\beta_{1,\ DS}$ in the region of the cover plate.

The vane outlet edge 21 is arranged opposite the vane inlet edge 20. A vane outlet angle $\beta_2$ is formed on the vane outlet edge 21, which vane outlet angle is defined as the angle of a tangent at an outer base point of the vane to the tangent to the circle circumference running through said base point. Similarly to the vane inlet angle $\beta_1$ formed at the vane inlet edge 20, the vane outlet angle $\beta_{2,\ TS}$ in the region of the support plate may also be different from the vane outlet angle $\beta_{2,\ DS}$ in the region of the cover plate.

As already mentioned, the vanes 18 are each formed by the assembly of the two vane halves 24, 25 and subsequent welding in the region of the vane inlet edge 20 and the vane outlet edge 21. The welded connection provided for this purpose may advantageously be designed as a laser welded connection, as a result of which the heat input into the vane halves which are being welded during the welding process is relatively small. The vanes are advantageously formed on the vane inlet edge 20 and on the vane outlet edge 21 by means of a welded seam (not shown) extending over the entire length of the vane inlet edge and the vane outlet edge 21.

A further important aspect is the connection of the vanes 18 firstly to the support plate 12 and secondly to the top plate 14 in the region of the side edges 19*a*, 19*b* arranged opposite one another.

As shown in FIGS. 2, 3, 6 and 7, in particular, a combination of welded connection and form-fitting connection is used as the fastening measure for fastening the vanes 18 firstly to the cover plate 14 and secondly to the support plate 12.

The form-fitting connection is designed as a plug connection with plug elements and mating plug elements assigned to one another formed firstly on the side edges 19*a*, *b* of the respective vane 18 and secondly on the cover or support plate 14, 12.

As shown in FIG. 6, in particular, the plug elements are formed as elongate plug pins 32, in particular. The elongate plug pins 32 could therefore also be referred to as plug tabs. The mating plug elements are designed as receiving openings receiving the plug pins. In the case of elongate plug pins or plug tabs, the receiving openings are designed as receiving slots 33.

As shown in FIG. 6, in particular, the elongate plug pins 32 are adapted to the contour of the outer faces 27, 28 of the vane halves 24, 25 and have a correspondingly curved design. The contour of the receiving slots 33 in this case is adapted to the contour of the elongate plug pins 32.

As shown by the overall view provided by FIGS. 2, 3 and 7, in particular, the outer faces 27, 28 lying opposite one another of a respective vane 18 have a characteristic design. The front outer face in the running direction, which belongs to the front vane half 24, could also be referred to as the outer face 27 on the pressure side, while the other outer face on the rear vane half can also be referred to as the outer face 28 on the suction side.

As shown in FIG. 7, in particular, the elongate plug pins 32 are arranged in alternate fashion on the suction side and on the pressure side, in other words alternating in the region of the outer face 27 on the pressure side and the outer face 28 on the suction side.

The forming of the plug pin 32 may likewise occur during the production of the two vane halves 24, 25, for example through the stamping-out or punching of the elongate plug pins from a vane half blank.

Figure 8:
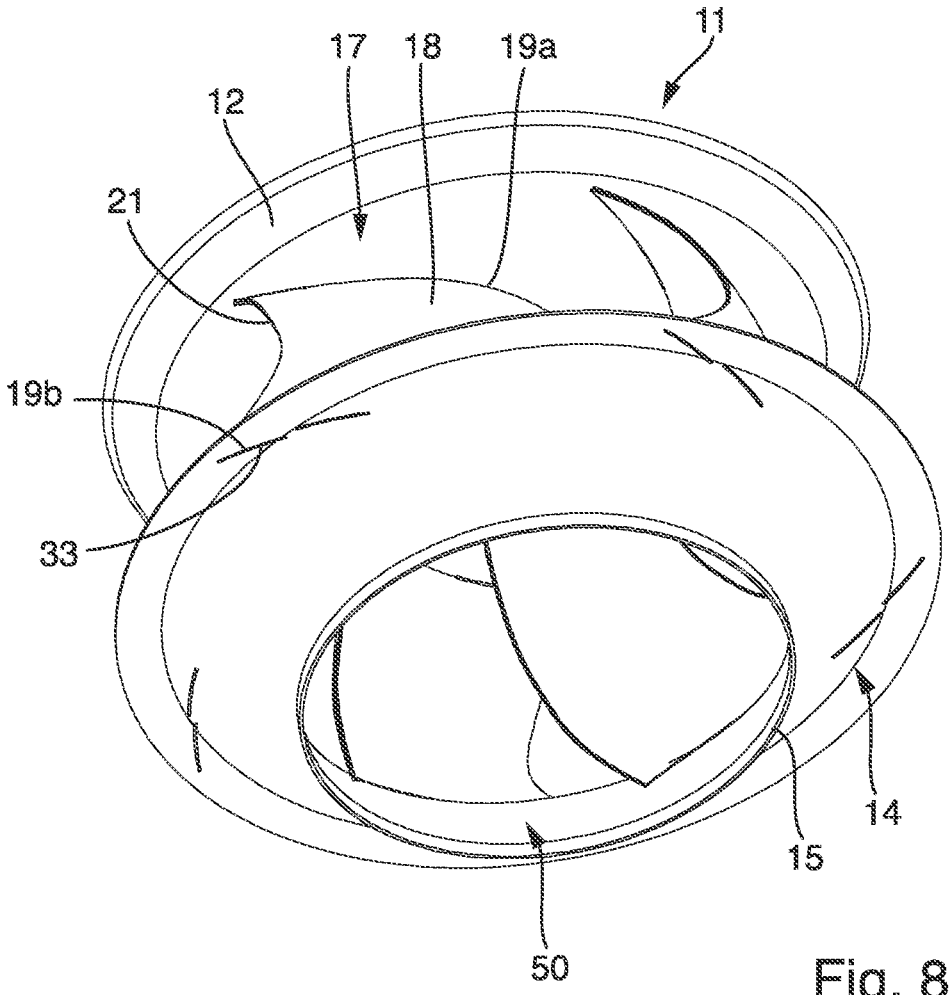

As shown in FIGS. 1 and 8, in particular, the support and cover plate 12, 14 have end regions 34, 35 projecting beyond a vane outlet diameter which is defined by the vane outlet edges 21 of the respective vanes 18, which end regions define a ring-shaped diffusion space or diffusor 36 which has a diffusor outer diameter. What is characteristic of the cross section of the diffusor 36 is that it does not have a rectangular or trapezoidal design, but is determined by the shape of the end region 35 of the support plate 12, which end region does not run out straight, but is curved in an arcuate manner.

The production of the radial impeller 11 takes place substantially as follows:

The two vane halves 24, 25 are initially supplied and assembled in such a manner that a hollow profile is formed and the two vane halves 24, 25 together form a vane inlet edge 20 and a vane outlet edge 21. The two vane halves 24, 25 must then of course be connected to one another or fastened to one another, which involves welding the two vane halves 24, 25 in the region of the vane inlet edge 20 and in the region of the vane outlet edge 21. This produces a hollow profile vane.

All vanes 18 required for the vane ring 17 are produced consecutively or simultaneously.

The vanes 18 are then each connected in the region of their side edges 19*a*, 19*b*, firstly to the cover plate 12 and secondly to the support plate.

It is characteristic of the production process for the vane halves 24, 25 to have been worked by means of plastic forming, in particular stamping, prior to supply and assembly. In this case, a convexly curved end portion 29 has been created from a vane half specimen, which end portion, along with the convexly curved end portion 30 of the other vane half, forms the characteristically shaped inlet end region 26, which extends with a continuously curved outer contour over both vane halves 24, 25.

The connection of the finally produced vanes 18, firstly to the support plate 12 and secondly the cover plate 14, takes place in that the elongate plug pins 32 on the side edges of the vanes 18 are fitted firstly into the receiving slot 33 on the support plate 12 and secondly into the receiving slot 33 on the cover plate 14. The plug connections thereby produced are then welded from the outside, so from the outside of the support plate 12 or of the cover plates 14 facing away from the vane ring, by means of a welded connection. Here, too, laser welding is a suitable welding method, in order to reduce the heat input.

Where necessary, welding can also be carried out from the inside, in order to stabilize the connection.

The invention claimed is:

1. A radial impeller, comprising: a cover plate with an inlet opening and a support plate, said plates being connected to one another by a vane ring having multiple vanes, wherein said vanes each have two side edges opposite one another, one of which is connected to the cover plate and the other to the support plate, wherein the side edges each extend between a vane inlet edge and a vane outlet edge which is opposite in a circumferential direction of the impeller, wherein the vanes each have a hollow profile and have two vane halves delimiting a cavity between them which are applied to one another and are each connected to one another in the region of the vane inlet edge and the vane outlet edge by a welded connection, wherein the vanes each have an inlet end region which tapers towards the vane inlet edge and which is formed by end portions of the two vane halves curved convexly on the outer faces of the vane halves facing away from one another, in such a manner that the inlet end region has a continuously curved outer contour extending over both vane halves, wherein the vane inlet edge and the vane outlet edge of a respective vane have an arcuate profile starting from the cover plate in the direction of the support plate, wherein the vanes are components which are separate from the cover plate and the support plate and are each connected in a region of their side edges to the cover plate and to the support plate by fastening measures that comprise a plug connection with elongate plug pins arranged on the vanes and mating plug elements in the form of receiving openings arranged on the cover plate and the support plate, and wherein the elongated plug pins are arranged in alternate fashion and are alternating in a region of an outer face of a first of the two vane halves and an outer face of a second of the two vane halves.

2. The radial impeller according to claim 1, wherein the convexly curved end portions are each formed portions produced without machining by plastic forming of a vane half blank.

3. The radial impeller according to claim 1, wherein the welded connection is a laser-welded connection.

4. The radial impeller according to claim 1, wherein the welded connection has at least one welded seam extending substantially over the entire length of the vane inlet edge and/or the vane outlet edge.

5. The radial impeller according to claim 1, wherein the fastening measures further comprise a welded connection, with which the vanes are each welded to the cover plate and to the support plate.

6. The radial impeller according to claim 1, wherein the elongate plug pins are adapted to the contour of the outer surfaces of the vane halves and likewise have a convexly curved design, wherein the contour of the receiving slot is adapted to the contour of the elongate plug pins.

7. The radial impeller according to claim 1, wherein the vanes are tilted from the inside outwards against the running direction and are in the form of backwardly curved vanes.

8. The radial impeller according to claim 1, wherein the vane inlet edge and/or the vane outlet edge of a respective vane has an arcuate profile starting from the cover plate in the direction of the support plate.

9. The radial impeller according to claim 1, wherein the vanes are each made of a aluminum or an aluminum alloy.

10. A method for producing the radial impeller according to claim 1, said method comprising the following steps:

provision of two vane halves and assembly of the two vane halves in such a manner that a hollow profile is formed and the two vane halves together form a vane inlet edge and a vane outlet edge, welding of the two vane halves in the region of the vane inlet edge and the vane outlet edge to form a vane, implementation of the aforementioned method steps to produce all vanes of the vane ring, and connection of the vanes in the region of the side edges thereof, firstly to the cover plate and secondly to the support plate.

11. The method according to claim 10, wherein the vane halves are each plastically formed prior to assembly in order to produce convexly curved inner portions.

12. The method according to claim 10, wherein the vanes are connected to the cover and support plate in a form-fitting manner via the combination of plug pins and the receiving slot and the plug connections of the plug pins with the receiving slots are then welded, wherein the welding takes place on an outer side of the cover plate or support plate facing away from the vane ring.

* * * * *